United States Patent [19]

Kurz

[11] Patent Number: 4,912,587

[45] Date of Patent: Mar. 27, 1990

[54] PROTECTIVE CIRCUIT FOR AN ELECTRICALLY DRIVEN LIQUID VACUUM CLEANER

[75] Inventor: Gerhard Kurz, Stuttgart, Fed. Rep. of Germany

[73] Assignee: Interlava AG, Lugano, Switzerland

[21] Appl. No.: 302,981

[22] Filed: Jan. 30, 1989

[30] Foreign Application Priority Data

Feb. 9, 1988 [DE] Fed. Rep. of Germany ..... 3803826

[51] Int. Cl.[4] ..... H02H 7/08

[52] U.S. Cl. ..... 361/23; 417/41; 417/36; 417/45

[58] Field of Search ..... 361/22, 31, 30; 417/18, 417/21, 25, 26, 27, 28, 40, 41, 43, 44, 45

[56] References Cited

U.S. PATENT DOCUMENTS 4,265,262 5/1981 Hotine ..... 417/36 X 4,295,793 10/1981 McGalliard ..... 417/36

*Primary Examiner*—Derek S. Jennings

*Attorney, Agent, or Firm*—Darby & Darby

[57] ABSTRACT

In connection with a protective circuit for an electrically driven liquid or water vacuum cleaner it is proposed to utilize the abrupt rise of the vacuum, which is encountered when a blocking element interrupts the connection between the receptacle for the liquid and the motor/blower area. The vacuum rise is detected by a diaphragm-type vacuum governor and used for triggering a lockable flip-flop which then interrupts the current supply of the drive motor. The locked condition can be released only by disconnecting the unit from the mains.

11 Claims, 2 Drawing Sheets

PROTECTIVE CIRCUIT FOR AN ELECTRICALLY DRIVEN LIQUID VACUUM CLEANER

BACKGROUND OF THE INVENTION

The present invention relates to a protective circuit according to the preamble of claim 1.

There have been known special vacuum cleaners or devices operating in the manner of a vacuum cleaner, which are capable also of taking up liquids. They are equipped for this purpose with a tank in which a vacuum is generated by means of a blower which is driven by a correspondingly strong electric motor so that it is possible to draw in and collect in this tank also liquids, via a corresponding line. There have also been known combined devices which are suited for drawing in dusts and solid matter, or the like, as well as water.

It is of course of problem of such devices, which will be described hereafter as liquid or water vacuum cleaners, that once the water level in the tank rises above a predetermined level, water particles or, quite generally, liquids may be drawn in which may be problematic for the function and trouble-free operation of such water vacuum cleaners, even when the corresponding shaft connections between the blower and the electric motor are sealed off sufficiently.

Consequently, it has been known before, and is common practice, to provide such water vacuum cleaners with level-controlled disconnection systems consisting, for example, of a water sensor arranged at a predetermined height inside the tank which may, for example, consist of two separate, current-carrying wires which, when liquid is drawn in, have resistance values differing in such a manner that this changed state can be detected and, for example, evaluated for switching off the motor.

It has also been known, in connection with other devices, to provide a blocking element which responds when a predetermined liquid or water level is reached in the tank, and causes the connection between the motor/blower area and the tank to be sealed off mechanically and, thus, to be interrupted. A known design of such a blocking element comprises a table-tennis ball which is guided in a cage and which is raised as the liquid level in the tank rises until it finally gets into the active suction area of the blower whereby it is drawn into contact with a seat which seals off the connection between the tank and the motor/blower.

In the case of this arrangement, the motor of the vacuum cleaner continues to operate and to drive the blower. In fact, this is of vital importance for the blocking effect as otherwise the table-tennis ball would loose its valve function and drop off. However, it is a problem of this arrangement that the person operating such a vacuum cleaner will not necessarily become aware of the fact that the connection has been interrupted as the overall noise produced by the unit will not change very much, while on the other hand the electric motor, being forced to work against a considerably higher resistance, may assume a dangerous condition. In any case, it may get considerably overheated, the windings may burn through and/or excessive carbon consumption, generation of sparks, or the like, may be encountered due to the electric motor operating against a high resistance, whereby its rotation is braked.

Now, it is the object of the present invention to improve a liquid or water vacuum cleaner, or combined dust and water vacuum cleaners, in such a manner that when the connection between the tank and the motor/- blower area has been closed the motor will be protected and trouble or damage will be prevented.

ADVANTAGES OF THE INVENTION

The protective circuit according to the invention solves this problem with the aid of the characterizing features of the main claim and provides the advantageous possibility to switch the motor off, i.e. to ensure that it will not be forced to continue to operate in a braked condition for longer or even very long periods of time, while preventing simultaneously and additionally that the whole process is repeated continuously, i.e. that the system starts sort of swinging, and this substantially with the aid of electric and, according to the present state of the art, extremely low-cost means.

The risk of swinging exists in all cases where a specific condition is utilized for triggering a certain action, for example in the present case the disconnection of the motor. Due to the fact that once the motor has been disconnected, the specific condition does no longer exist, it is now of course no longer necessary to have the motor disconnected so that the latter is switched on again, whereby the specific condition is reestablished, and so on.

The features described by the sub-claims permit advantageous improvements and further developments of the protective circuit specified by the main claim. In fact, the protective circuit is designed in such a manner that after disconnection of the electric motor it assumes a blocked condition, in the manner of an electric fuse protection, and can be released or restored from this blocked condition only after the mains plug has been pulled or the vacuum cleaner has been switched off so that the user is provided the possibility to empty the full tank.

The protective circuit according to the invention, therefore, ensures that once the motor has been disconnected, the whole unit can be manipulated safely and without causing trouble, even if it has not been separated from the mains or if the off switch has not been actuated, as the blocked condition can be overcome only after manual switching-off of the unit or separation of the unit from the mains.

It is another advantage of the invention that, apart from the vacuum governor which is anyway sufficiently small, the electric parts of the protective circuit may be accommodated commonly within extremely small space and may even be enclosed completely, for example embedded in a sealing compound in a fully sealed housing, if they are not integrated anyway.

BRIEF DESCRIPTION OF THE DRAWINGS

The drawings show one embodiment of the invention which will be described in more detail by the following specification.

DESCRIPTION OF THE EMBODIMENTS

It is the basic idea of the present invention to utilize the abrupt rise of the vacuum occurring when the blocking element responds (as the pressure is now no longer balanced by the atmosphere) with the aid of a vacuum governor which is set to a corresponding threshold value, and to arrange this vacuum governor within an electric triggering circuit for the electric motor driving the blower of the water vacuum cleaner in such a manner that the electric motor is switched off irreversibly, i.e. that the motor can be switched on again only after the mains plug has been pulled or the unit has been switched off definitely in some other manner, for example by actuating the off switch which is provided as standard in most of the cases.

Figure 2:
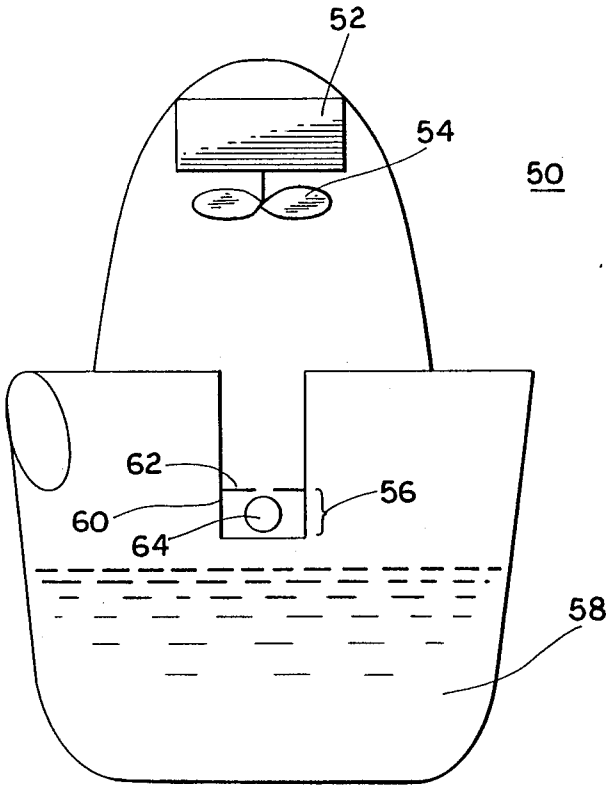
FIG. 2 illustrates the general structure of a vacuum, including the motor, blower and blocking element.

FIG. 2 shows the structure and function of a so-called water vacuum cleaner 50, 50 and a combined dust and water vacuum cleaner. A blocking element 56, where the connection between the tank 58 and the motor 52, blower 54 area is interrupted, for example, by means of a table-tennis ball 64 which is guided in a cage 60 and pulled against a seat 62 by the vacuum generated.

The invention starts out from the above arrangements and proposes the arrangement of a vacuum governor, preferably a diaphragm-type vacuum governor of the type known as such for special applications, for example for determining the filling level of the dust bag of vacuum cleaners (see for example DE-PS 27 12 201 and DE PS 28 35 473), at any desired position where a pressure rise is encountered when the blocking element assumes its blocked position.

Figure 1:
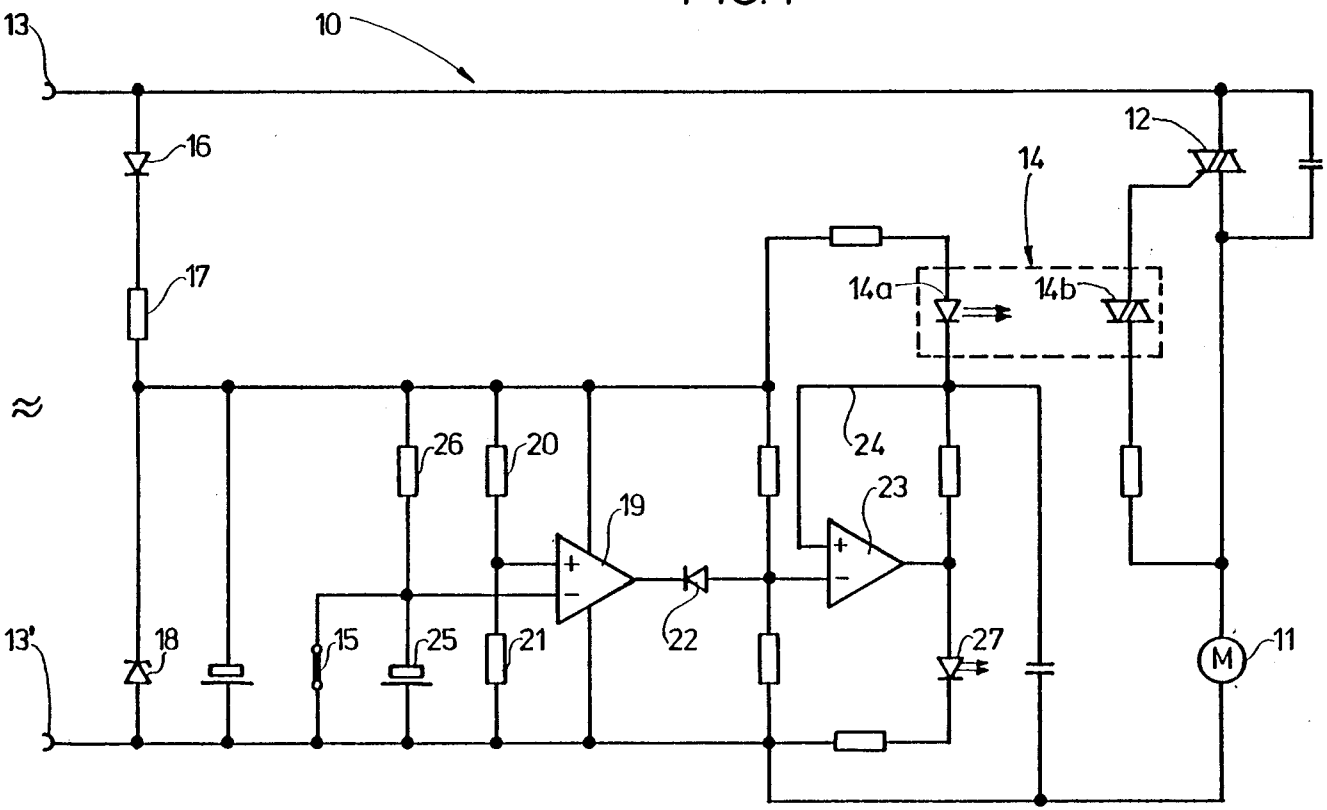
FIG. 1 shows a detailed diagram illustrating the basic structure of the electric circuit for switching off the electric drive motor, and its transition to the blocked condition.

FIG. 1 shows a diaphragm-type vacuum governor is designated in the drawing by reference numeral 15 and designed as a normally-closed switch, in the illustrated embodiment of the invention. The protective circuit is generally designated by 10 and comprises a controllable semiconductor switching element, preferably a main triac 12 connected in series with the drive motor 11, which in the triggered condition connects the drive motor 11 to the input terminals 13, 13+ practically free from resistance, while in the non-triggered condition it disconnects the drive motor 11 from its supply voltage.

Triggering of the main triac 12 is effected by a so-called optotriac 14, but may generally be effected by any desired circuit means if they are only selected to ensure that they respond, and disconnect the motor 11 from the mains, when the vacuum governor responds.

It should be noted in this connection that the circuit shown in the drawing, which depicts the invention with the aid of discrete circuit elements, is not meant to limit the invention but intended only to illustrate the basic functional effects of the invention and special functional sequences of this particular embodiment. It goes without saying that the invention may be implemented also with the aid of purely digital or hybrid, largely integrated circuit blocks, or may also comprise corresponding parts of a program-controlled digital system, for example a single-purpose computer, micro-processor, or the like, which may be integrated fully or in part.

In the case of the illustrated embodiment of the invention, the rectifier diode 16, together with the series resistance 17 and another Zener diode 18, perform the function of supplying the circuit with the necessary voltage; the described elements are then following by a first operational amplifier 19 whose one input is supplied with a constant threshold voltage, via the resistors 20 and 21, and whose other input (− input) is supplied with the triggering voltage via the vacuum governor 15 designed as normally-closed contact, which triggering voltage is responsible in the present case for switching off the motor 11 and for the transition into the blocked condition. A diode 22 adapted to let negative triggering pulses pass connects the output of the first operational amplifier 19 to another circuit element having the general form of an operational amplifier, but forming in the present case a bistable flip-flop 23 which can be switched over from one into the other stable condition via the diode 22. To this end, the basic form of the operational amplifier forming the flip-flop 23 is selected so that the output and the input (+ input) are interconnected by a feedback line 24 which imparts to the flip-flop its bistable property. The further elements of the circuit arrangement need not be discussed here in detail, it being sufficient to state that they complete the circuitry and ensure, at least in the case of the illustrated embodiment, that every time the illustrated system is switched, i.e. connected to mains potential, the output of the flip-flop 23 is connected to earth or zero potential, at least in the case of the illustrated embodiment. This means that the flip-flop always assumes a first switching position in which the motor is connected to the mains.

The system, therefore, functions basically as follows: The earth potential connected to the output of the flip-flop element 23 causes the luminous diode **14*a* in the area of the optotriac 14 to be triggered and the triac portion 14*b* of the optotriac 14 to be switched through and to supply the drive motor 11 with the required supply voltage via the main triac 12**.

The vacuum governor 15 is closed under these conditions. It responds only, i.e. changes over to its open condition, when the blocking element responds under the action of the rising vacuum.

The opening of the contacts of the vacuum governor 15 leads to the capacitor 25 being charged up corresponding to its charging time constants, via the resistor 26, in parallel to the vacuum governor, to—in the present case—increasingly positive voltages until the first operational amplifier 19 responds and supplies at its output a negative pulse which causes the flip-flop 23, via the diode 22, to assume its blocked condition. One then obtains a positive voltage or a logic 1 signal at the output of the flip-flop 23. The luminous diode **14*a* of the optotriac 14 is blocked, and the—for example—red luminous diode 27 lights up simultaneously so that the operator is warned also optically that the protective circuit has responded and has switched off the drive motor. The same indication is also indicative of the blocked condition, as the red luminous diode 27** will continue to light and to indicate the impossibility to start the unit again until the unit has been either switched off or separated from the mains in any other manner.

The capacitor 25 connected in parallel to the contacts 15 of the vacuum governor serves the additional function to prevent the system from reacting when the vacuum values rise only occasionally to values at which the vacuum governor, which is set to a given threshold value, might respond. The capacitor 25 requires a predetermined period of time, resulting substantially from the RC element combination of this capacitor 25, and the resistor 26, until it reaches the threshold voltage at which the first operational amplifier 29 responds. This prevents the motor protection system from reacting immediately if the suction system should be blocked occasionally and the vacuum should rise only momentaneously. The circuit will only respond in this case, and switch off the motor, when a longer period of time, which can be predetermined by the timing of the RC element 25/26, for example 3 seconds, have lapsed.

All features that have been explained and described in the specification, the following claims and the drawing may be essential to the invention either alone or in any desired combination thereof.

I claim:

1. Protective circuit for electrically driven liquid or water vacuum cleaners, or combined dust and water vacuum cleaner, comprising a blower which is driven by the motor, a receptacle (tank) for the liquid and other matter drawn in, and a blocking element which blocks the suction line between the tank and the area of the blower/electric motor when the liquid level in the tank exceeds a predetermined level, characterized in that a vacuum governor (15) responding in this case and triggering an electric supply circuit (12) for the electric motor (11) to interrupt the further supply of voltage is arranged downstream of the blocking element and, accordingly, exposed to the high vacuum action produced by the closed condition of the blocking element.

2. Protective circuit according to claim 1, characterized in that the vacuum governor (15) is a diaphragm-type vacuum switch with normally-closed contacts.

3. Protective circuit according to claim 1, characterized in that a main triac (12), which is controlled by a flip-flop 23, is connected in series with the motor connection terminals.

4. Protective circuit according to claim 3, characterized in that the flip-flop (23) is designed and controlled in such a manner that when the supply voltage is initially applied, it assumes a first switching condition in which the drive motor (11) is supplied with voltage via the main triac (12), and that when the bistable flip-flop (23) is triggered once, due to the function of the vacuum governor (15), it assumes its second, blocked condition in which the current supply to the drive motor (11) is interrupted, and can be released from this condition only after the unit has been disconnected from the mains.

5. Protective circuit according to claim 4, characterized in that an indicator lamp (luminous diode 27) is provided which indicates the existence of the blocked condition to the outside.

6. Protective circuit according to claim 1, characterized in that an input circuit is provided which includes the vacuum governor (15) in the form of a normally-closed switch and which further comprises a delay element (25, 26) permitting the bistable flip-flop (23) to be triggered only when a predetermined time threshold has been exceeded so that short-time increases of the vacuum will remain without effect.

7. Protective circuit according to claim 6, characterized in that the normally-closed contacts of the vacuum governor (15) are connected in parallel to a capacitor (25) which is connected in series to a charging resistance to form together with the latter an RC element predetermining the response threshold time.

8. Protective circuit according to claim 7, characterized in that the RC element (25, 26) is connected by its other input to an operational amplifier (19) with predetermined threshold voltage and that the operational amplifier (19) will connect through when the voltage across the capacitor (25) connected in parallel to the vacuum governor (15) reaches a predetermined value, when the contacts of the vacuum governor are open.

9. Protective circuit according to claim 8, characterized in that the operational amplifier 19 acts to switch the bistable flip-flop (23) connected to its output into its blocked condition, by an output pulse, and that the output of the flip-flop (23) is connected to an optotriac (14) directly controlling the main triac (12).

10. Protective circuit according to claim 1, characterized in that when the voltage supply is interrupted, the supply circuit assumes a blocked condition which can be reversed only by disconnecting the unit from the mains.

11. Protective circuit according to claim 1, characterized in that the blocking element consists of a table-tennis ball guided in a cage.

* * * * *